US011293111B2

(12) United States Patent
Yu et al.

(10) Patent No.: US 11,293,111 B2
(45) Date of Patent: Apr. 5, 2022

(54) PLATING BRONZE ON POLYMER SHEETS

(71) Applicant: 3M INNOVATIVE PROPERTIES COMPANY, St. Paul, MN (US)

(72) Inventors: Steven Y. Yu, St. Paul, MN (US); Gene B. Nesmith, Lago Vista, TX (US); Larry S. Hebert, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 657 days.

(21) Appl. No.: 15/571,118

(22) PCT Filed: Jun. 13, 2016

(86) PCT No.: PCT/US2016/037256
§ 371 (c)(1),
(2) Date: Nov. 1, 2017

(87) PCT Pub. No.: WO2016/205134
PCT Pub. Date: Dec. 22, 2016

(65) Prior Publication Data

US 2018/0347059 A1 Dec. 6, 2018

Related U.S. Application Data

(60) Provisional application No. 62/180,352, filed on Jun. 16, 2015.

(51) Int. Cl.

| | |
|---|---|
| ***C25D 3/58*** | (2006.01) |
| ***C25D 5/18*** | (2006.01) |
| ***C25D 5/56*** | (2006.01) |
| ***C23C 28/02*** | (2006.01) |
| ***C22C 9/02*** | (2006.01) |
| ***C25D 5/34*** | (2006.01) |

(52) U.S. Cl.
CPC ..... *C25D 3/58* (2013.01); *C22C 9/02* (2013.01); *C23C 28/023* (2013.01); *C25D 5/18* (2013.01); *C25D 5/34* (2013.01); *C25D 5/56* (2013.01)

(58) Field of Classification Search
CPC ..... C25D 3/58; H02G 13/00
See application file for complete search history.

(56) References Cited

U.S. PATENT DOCUMENTS

| | | | | |
|---|---|---|---|---|
| 5,378,347 | A | 1/1995 | Thomson | |
| 6,607,653 | B1 * | 8/2003 | Tsuji | C25D 3/60 205/241 |
| 7,780,839 | B2 | 8/2010 | Egli | |
| 8,503,153 | B2 | 8/2013 | Hebert | |
| 8,922,970 | B2 | 12/2014 | Hebert | |
| 2006/0260948 | A2 | 11/2006 | Zschintzsch | |
| 2007/0014997 | A1 * | 1/2007 | Zhang | B29C 59/04 428/446 |
| 2008/0257745 | A1 * | 10/2008 | Urata | A44B 17/00 205/241 |
| 2009/0188807 | A1 * | 7/2009 | Egli | C25D 3/60 205/241 |
| 2010/0263898 | A1 * | 10/2010 | Hebert | B64C 1/12 174/2 |
| 2011/0052937 | A1 * | 3/2011 | Kanno | C25D 3/58 428/659 |
| 2011/0303092 | A1 * | 12/2011 | Ma | B01D 67/0069 96/11 |
| 2012/0282486 | A1 * | 11/2012 | Maeda | C25D 5/505 428/647 |
| 2013/0236742 | A1 * | 9/2013 | Weitershaus | C25D 3/60 428/674 |
| 2014/0141821 | A1 | 5/2014 | Dietz et al. | |
| 2014/0293498 | A1 | 10/2014 | Hebert | |
| 2017/0245372 | A1 * | 8/2017 | Johal | C23C 18/1651 |

FOREIGN PATENT DOCUMENTS

| | | | |
|---|---|---|---|
| DE | 10 2012 008544 | | 11/2013 |
| EP | 2 071 057 | | 6/2009 |
| EP | 14181187.7 | * | 8/2015 |
| JP | 2004010907 A | * | 1/2004 |
| WO | WO 2010/121044 | | 10/2010 |
| WO | WO-2015055213 A1 | * | 4/2015 |

OTHER PUBLICATIONS

Mizutani, machine translation, JP 2004-10907 A (Year: 2004).*
Lou et al., Electroplating, Encyclopedia of Chem. Proc. (Year: 2006).*
Mizutani et al., Partial Human Translation, JP 2004-10907 A. (Year: 2004).*
Chaim, R., "Effect of grain size on elastic modulus and hardness of nanocrystalline ZrO2-3wtT Y2O3 ceramic," *Journal of Materials Science*, vol. 39, pp. 3057-3061 (2004).
Mandich, N.V., "Troubleshooting Decorative Bronze Plating Systems," *Metal Finishing*, vol. 101, No. 6., pp. 97-106, (2003).
(Continued)

*Primary Examiner* — Harry D Wilkins, III
*Assistant Examiner* — Ho-Sung Chung
(74) *Attorney, Agent, or Firm* — Philip P. Soo

(57) ABSTRACT

An electroplated article is provided comprising a polymeric substrate bearing an electroplated metal layer comprising copper and tin in an atomic ratio of less than 96:4, in some embodiments less than 87:13 and in some embodiments less than 82:18; wherein the atomic ratio of copper to tin is greater than 55:45, and wherein the electroplated metal layer comprises at least 3.5 weight % tin. The electroplated metal layer comprises an alloy having a melting point of less than 1050° C. and in some cases less than 800° C. The electroplated metal layer has a Young's Modulus of less than 15.0 GPa, in some embodiments less than 13.0 GPa, and in some less than 10.0 GPa. In addition, an electroplating solution is provided comprising Cu(II) ions, Sn (II) ions, Zn(II) ions, 1-methionine, and no cyanide anion.

17 Claims, No Drawings

(56) References Cited

OTHER PUBLICATIONS

Moshohoritou, R., "The Effects of Some Additives on the Throwing Power and Stability of Tin (II) Solutions during A-C Coloring of Anodized Aluminum Part I: Heterocyclic Organic Compounds," *Plating and Surface Finishing*, vol. 81, No. 1, pp. 60-64, (1994).

Murase, K., et al., "Preparation of Cu—Sn Layers on Polymer Substrate by Reduction-Diffusion Method Using Ionic Liquid Baths," *J. Electrochem. Soc.*, 158 (6), pp. D335-D341, (2011).

Nakamura, T., "Electrodeposition of CuSn Alloy from Noncyanide Sulfosuccinate Bath," *Materials Science Forum*, vol. 654-656, pp. 1912-1915, (2010).

Schlesinger, M., et al., "Tin and Tin Alloys for Lead-Free Solder," *Modern Electroplating, Fifth Edition*, eds., NY, pp. 139-204 (2010).

Strow, H., "Brass and Bronze Plating," *Metal Finishing*, vol. 102, No. 4, pp. 169-173, (2004).

International Search Report for PCT/US2016/037256 dated Dec. 7, 2016 (7 pages).

De Carvalho, et al., "Electrodeposition of copper-tin-zinc ternary alloys from disodium ethylenediaminetetraacetate bath", *Surface and Coatings Technology*, vol. 262, (Jan. 25, 2015) pp. 11-122.

* cited by examiner

PLATING BRONZE ON POLYMER SHEETS

CROSS REFERENCE TO RELATED APPLICATIONS

This application is a national stage filing under 35 U.S.C. 371 of PCT/US2016/037256, filed Jun. 13, 2016, which claims the benefit of U.S. Provisional Patent Application No. 62/180,352, filed Jun. 16, 2015, the disclosures of which are incorporated by reference in their entirety herein.

FIELD OF THE DISCLOSURE

This disclosure relates to bronze electroplating solutions and methods useful in plating bronze alloys on polymer substrates such as flexible polymer sheets, as well as articles comprising a polymeric substrate bearing an electroplated bronze layer.

BACKGROUND OF THE DISCLOSURE

The following references may be relevant to the general field of technology of the present disclosure: "Brass and Bronze Plating," H. Strow, Metal Finishing, Vol. 102, No. 4, pp. 169-173, 2004; "Troubleshooting Decorative Bronze Plating Systems," N. V. Mandich, Metal Finishing, Vol. 101, No. 6, pp. 97-106, 2003; "The Effects of Some Additives on the Throwing Power and Stability of Tin (II) Solutions during A-C Coloring of Anodized Aluminum Part I: Heterocyclic Organic Compounds," by R. Moshohoritou, Plating and Surface Finishing, Vol. 81, No. 1, pp. 60-64, 1994; "Tin and Tin Alloys for Lead-Free Solder," Modern Electroplating, Fifth Edition, eds. M. Schlesinger, and M. Paunovic, NY, 2010, pp. 139-204; "Reducing Tin Sludge in Acid Tin Plating," U.S. Pat. No. 5,378,347; "Electroplating Bronze," U.S. Pat. No. 7,780,839; "Electrodeposition of CuSn Alloy from Noncyanide Sulfosuccinate Bath," T. Nakamura, Materials Science Forum, Vol. 654-656, pp. 1912-1915, 2010; and "Preparation of Cu—Sn Layers on Polymer Substrate by Reduction-Diffusion Method Using Ionic Liquid Baths," K. Murase et al., J. Electrochem. Soc., 158 (6), pp. D335-D341, 2011.

SUMMARY OF THE DISCLOSURE

Briefly, the present disclosure provides an electroplated article comprising a polymeric substrate bearing an electroplated metal layer comprising copper and tin in an atomic ratio of less than 96:4 and greater than 55:45 and wherein the electroplated metal layer comprises at least 3.5 weight % tin. In some embodiments, the electroplated metal layer comprises copper and tin in an atomic ratio of less than 87:13, and in some embodiments less than 82:18. In some embodiments, the electroplated metal layer comprises an alloy having a melting point of less than 1050° C., in some less than 1000° C., in some less than 900° C., and in some less than 800° C. In some embodiments, the electroplated metal layer additionally comprises greater than 0.001 weight % zinc. In some embodiments, the electroplated metal layer additionally comprises greater than 0.01 weight % sulfur. In some embodiments, the electroplated metal layer has a Young's Modulus of less than 15.0 GPa, in some less than 13.0 GPa, and in some less than 10.0 GPa. The electroplated article may additionally comprises a tie/seed layer between the polymeric substrate and the electroplated metal layer, typically in direct contact with the polymeric substrate. In some embodiments, the polymeric substrate comprises a thermoplastic polymer, in others, a polyolefin resin, and in others a polymer derived from an epoxy resin. Additional embodiments of the electroplated article of the present disclosure are described below under "Selected Embodiments."

In another aspect, the present disclosure provides an electroplating solution comprising: i) x molar parts Cu(II) ions; ii) y molar parts Sn (II) ions; iii) z molar parts Zn(II) ions; and iv) m molar parts 1-methionine; where x+y+z=100 and x is between 52 and 77, y is between 22 and 48, and z is between 1 and 9; and where m is between 1.6 and 6.0 times x. In some embodiments, x is between 60 and 70, y is between 30 and 40, z is greater than 3, and m is greater than 2.5 times x. In some embodiments the electroplating solution comprises no cyanide anion. In some embodiments Cu(II) ions are provided as Cu(II) sulfate, in some embodiments Sn(II) ions are provided as Sn (II) sulfate, and in some embodiments Zn(II) ions are provided Zn(II) sulfate. In some embodiments the electroplating solution additionally comprises an antioxidant; typically selected from ascorbic acid and d-sodium isoascorbate; most typically d-sodium isoascorbate. Additional embodiments of the electroplating solution of the present disclosure are described below under "Selected Embodiments."

In another aspect, the present disclosure provides an electroplating method comprising the steps of: a) immersing a polymeric substrate bearing a metallic tie/seed layer into an electroplating solution according to the present disclosure and b) passing an electrical current through the polymeric substrate so as to reduce anions in the electroplating solution. In some embodiments, the electroplating solution is stirred, circulated or agitated during step b) and the Cu/Sn ratio in the electroplated article is controlled by control of the rate of stirring circulating or agitating of the electroplating solution during step b). In some embodiments the electrical current is pulsed. Additional embodiments of the electroplating method of the present disclosure are described below under "Selected Embodiments."

All scientific and technical terms used herein have meanings commonly used in the art unless otherwise specified. The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

DETAILED DESCRIPTION

The present disclosure provides bronze electroplating solutions, methods useful in plating bronze alloys on polymeric substrates such as flexible polymer sheets, and articles that comprise a bronze layer electroplated on a polymeric substrate.

The authors have found that bronzes comprising a high level of tin—at least 4 atomic % but preferably at least 13 atomic %, more preferably at least 18 atomic %, and in some cases at least 27 atomic %—may be of particular interest since they have high electrical conductivity and high corrosion resistance yet reduced melting point relative to pure copper, and are thus useful in the lightning protection sheets described in, e.g., U.S. Pat. No. 8,922,970, issued Dec. 30, 2014; U.S. Pat. No. 8,503,153, issued Aug. 6, 2013; U.S. Pat. No. 8,503,153, issued Jun. 24, 2014; and US Publ. No. 2014/0293498, filed Jun. 12, 2014; the contents of which are incorporated herein by reference. Copper alone is of limited utility in such an application due to its melting point of about 1085° C., which is higher than ideal. For use in such an application, a conductor with a lower melting point is more useful, preferably less than 1050° C., more preferably less than 1000° C., more preferably less than 900° C., and most preferably less than 800° C. In contrast, a bronze containing a 95/5 atomic ratio of Cu/Sn has a melting point of about 1010° C. and a bronze containing a 80/20 atomic ratio of Cu/Sn has a melting point of about 750° C., making these bronzes more useful in lightning protection sheets such as those described in the patents cited above.

However the authors have found that electroplating bronzes comprising a high level of tin presents special challenges not encountered when plating lower tin content bronzes, for at least the reason that copper tends to plate out in overwhelming preference to tin. Furthermore the authors have found that electroplating a durable metal layer on a thin, flexible polymeric substrate presents special challenges not encountered when plating on solid metal substrates, since the substrate is flexible and dimensionally unstable in comparison to a solid metal substrate and not inherently conductive.

In certain embodiments of the present disclosure, an especially durable bronze comprising relatively high levels of tin, suitable for plating on a thin polymer sheet, can be consistently electroplated on a polymer substrate, without the use of an electroplating bath comprising tin in excess of copper, and without the use of dangerous cyanide salts.

In certain embodiments of the present disclosure, an especially durable bronze is obtained by including a relatively small amount of zinc in the electroplating bath along with copper and tin. The resulting electroplated bronze contains very small amounts of tin, however it is far more durable, as reflected in a reduced Young's Modulus of less than 15.0 GPa, in some cases less than 13.0 GPa, in some less than 11.0 GPA, and in some less than 10.0 GPa. The Examples below demonstrate a reduction in Young's Modulus from 16.1 GPa to 9.7 GPa due to the inclusion of very small amounts of zinc. As further illustrated in the Examples, the electroplated bronze without zinc cracked when the polymeric substrate was bent to a 90 degree angle yet the electroplated bronze with zinc did not, making it an especially suitable high-tin bronze electroplate for use on a flexible polymeric sheet.

In certain embodiments of the present disclosure, the electroplating bath includes 1-methionine for regulation of Cu plating. As a result, the use of large excesses of tin is avoided. Furthermore, the use of dangerous cyanide salts is avoided. Finally, the need to replenish tin during plating is reduced or avoided. As a result of the use of 1-methionine in the electroplating bath, small amounts of sulfur derived from 1-methionine may be detectable in the electroplated metal layer.

In some embodiments of the present invention, a more stable electroplating solution may be obtained by adding an antioxidant, with exceptional results being demonstrated by the authors for the use of ascorbic acid, or, even more advantageously, d-sodium isoacrorbate.

In certain embodiments of the present disclosure, the durability of the electroplated article can be enhanced by the use of the appropriate tie/seed layer, i.e., a layer performing the functions of both a tie layer (serving to increase binding between the electroplated layer and the polymeric substrate) and a seed layer (serving to impart sufficient conductivity to the polymer substrate to enable electroplating on the polymer substrate). The tie/seed layer may be applied by any suitable method, but is typically applied by sputtering or vacuum deposition. The tie/seed layer typically comprises, first, a tie material, most preferably selected from chromium, titanium or tin. The tie/seed layer typically comprises additional layers of conductive metal such as copper, silver or gold. The tie/seed layer is typically thin, in some embodiments less than 1.0 μm in thickness and in some embodiments less than 0.3 μm in thickness.

Selected Embodiments

The following embodiments, designated by letter and number, are intended to further illustrate the present disclosure but should not be construed to unduly limit this disclosure.

PP1. An electroplated article comprising a polymeric substrate bearing an electroplated metal layer comprising copper and tin in an atomic ratio of less than 96:4.

PP2. The electroplated article according to embodiment PP1 wherein the electroplated metal layer comprises copper and tin in an atomic ratio of less than 92:8.

PP3. The electroplated article according to embodiment PP1 wherein the electroplated metal layer comprises copper and tin in an atomic ratio of less than 87:13.

PP4. The electroplated article according to embodiment PP1 wherein the electroplated metal layer comprises copper and tin in an atomic ratio of less than 82:18.

PP5. The electroplated article according to embodiment PP1 wherein the electroplated metal layer comprises copper and tin in an atomic ratio of less than 78:22.

PP6. The electroplated article according to embodiment PP1 wherein the electroplated metal layer comprises copper and tin in an atomic ratio of less than 76:24.

PP7. The electroplated article according to embodiment PP1 wherein the electroplated metal layer comprises copper and tin in an atomic ratio of less than 73:27.

PPB. The electroplated article according to embodiment PP1 wherein the electroplated metal layer comprises copper and tin in an atomic ratio of less than 71:29.

PP9. The electroplated article according to any of the preceding embodiments wherein the electroplated metal layer comprises copper and tin in an atomic ratio of greater than 55:45.

PP10. The electroplated article according to any of the preceding embodiments wherein the electroplated metal layer comprises copper and tin in an atomic ratio of greater than 65:35.

PP11. The electroplated article according to any of the preceding embodiments wherein the electroplated metal layer comprises copper and tin in an atomic ratio of greater than 68:32.

PP12. The electroplated article according to any of the preceding embodiments wherein the electroplated metal layer comprises at least 50 weight % copper.

PP13. The electroplated article according to any of the preceding embodiments wherein the electroplated metal layer comprises at least 3.5 weight % tin.

PP14. The electroplated article according to any of the preceding embodiments wherein the electroplated metal layer comprises at least 8.0 weight % tin.

PP15. The electroplated article according to any of the preceding embodiments wherein the electroplated metal layer comprises an alloy having a melting point of less than 1050° C.

PP16. The electroplated article according to any of the preceding embodiments wherein the electroplated metal layer comprises an alloy having a melting point of less than 1000° C.

PP17. The electroplated article according to any of the preceding embodiments wherein the electroplated metal layer comprises an alloy having a melting point of less than 900° C.

PP18. The electroplated article according to any of the preceding embodiments wherein the electroplated metal layer comprises an alloy having a melting point of less than 800° C.

PP19. The electroplated article according to any of the preceding embodiments wherein the electroplated metal layer additionally comprises greater than 0.001 weight % zinc.

PP20. The electroplated article according to any of the preceding embodiments wherein the electroplated metal layer additionally comprises greater than 0.005 weight % zinc.

PP21. The electroplated article according to any of the preceding embodiments wherein the electroplated metal layer additionally comprises greater than 0.010 weight % zinc.

PP22. The electroplated article according to any of the preceding embodiments wherein the electroplated metal layer additionally comprises greater than 0.01 weight % sulfur.

PP23. The electroplated article according to any of the preceding embodiments wherein the electroplated metal layer additionally comprises greater than 0.05 weight % sulfur.

PP24. The electroplated article according to any of the preceding embodiments wherein the electroplated metal layer additionally comprises greater than 0.10 weight % sulfur.

PP25. The electroplated article according to any of the preceding embodiments wherein the electroplated metal layer has a Young's Modulus of less than 15.0 GPa.

PP26. The electroplated article according to any of the preceding embodiments wherein the electroplated metal layer has a Young's Modulus of less than 13.0 GPa.

PP27. The electroplated article according to any of the preceding embodiments wherein the electroplated metal layer has a Young's Modulus of less than 11.0 GPa.

PP28. The electroplated article according to any of the preceding embodiments wherein the electroplated metal layer has a Young's Modulus of less than 10.0 GPa.

PP29. The electroplated article according to any of the preceding embodiments additionally comprising a tie/seed layer between the polymeric substrate and the electroplated metal layer, wherein the tie/seed layer is in direct contact with the polymeric substrate.

PP30. The electroplated article according to embodiment PP29 wherein the tie/seed layer is in direct contact with the electroplated metal layer.

PP31. The electroplated article according to any of embodiments PP29-PP30 wherein the tie/seed layer includes a layer of chromium in direct contact with the polymeric substrate.

PP32. The electroplated article according to any of embodiments PP29-PP30 wherein the tie/seed layer includes a layer of chromium in direct contact with the polymeric substrate and a layer of copper in direct contact with the layer of chromium.

PP33. The electroplated article according to any of embodiments PP29-PP30 wherein the tie/seed layer includes a layer of chromium in direct contact with the polymeric substrate and a layer of copper in direct contact with the layer of chromium, wherein the layer of copper is in direct contact with the electroplated metal layer.

PP34. The electroplated article according to any of embodiments PP29-PP30 wherein the tie/seed layer includes a layer of titanium in direct contact with the polymeric substrate.

PP35. The electroplated article according to any of embodiments PP29-PP30 wherein the tie/seed layer includes a layer of titanium in direct contact with the polymeric substrate and a layer of copper in direct contact with the layer of titanium.

PP36. The electroplated article according to any of embodiments PP29-PP30 wherein the tie/seed layer includes a layer of titanium in direct contact with the polymeric substrate and a layer of copper in direct contact with the layer of titanium, wherein the layer of copper is in direct contact with the electroplated metal layer.

PP37. The electroplated article according to any of embodiments PP29-PP30 wherein the tie/seed layer includes a layer of tin in direct contact with the polymeric substrate.

PP38. The electroplated article according to any of embodiments PP29-PP30 wherein the tie/seed layer includes a layer of tin in direct contact with the polymeric substrate and a layer of copper in direct contact with the layer of tin.

PP39. The electroplated article according to any of embodiments PP29-PP30 wherein the tie/seed layer includes a layer of tin in direct contact with the polymeric substrate and a layer of copper in direct contact with the layer of tin, wherein the layer of copper is in direct contact with the electroplated metal layer.

PP40. The electroplated article according to any of embodiments PP29-PP39 wherein the tie/seed layer has a thickness of less than 1.0 μm.

PP41. The electroplated article according to any of embodiments PP29-PP39 wherein the tie/seed layer has a thickness of less than 0.3 μm.

PP42. The electroplated article according to any of the embodiments PP1-PP41 wherein the polymeric substrate comprises a thermoplastic polymer.

PP43. The electroplated article according to any of embodiments PP1-PP41 wherein the polymeric substrate comprises a thermoset polymer.

PP44. The electroplated article according to any of embodiments PP1-PP41 wherein the polymeric substrate comprises a polyolefin polymer.

PP45. The electroplated article according to any of embodiments PP1-PP41 wherein the polymeric substrate comprises a polypropylene polymer.

PP46. The electroplated article according to any of embodiments PP1-PP41 wherein the polymeric substrate comprises a polyester polymer.

PP47. The electroplated article according to any of embodiments PP1-PP41 wherein the polymeric substrate comprises a polyurethane polymer.

PP48. The electroplated article according to any of embodiments PP1-PP41 wherein the polymeric substrate comprises a polymer derived from an epoxy resin.

PP49. The electroplated article according to any of embodiments PP1-PP48 wherein the polymeric substrate has a thickness of less than 1400 μm.

PP50. The electroplated article according to any of embodiments PP1-PP48 wherein the polymeric substrate has a thickness of less than 420 μm.

PP51. The electroplated article according to any of embodiments PP1-PP48 wherein the polymeric substrate has a thickness of less than 280 μm.

PP52. The electroplated article according to any of embodiments PP1-PP48 wherein the polymeric substrate has a thickness of less than 140 μm.

PP53. The electroplated article according to any of embodiments PP1-PP48 wherein the polymeric substrate has a thickness of less than 70 μm.

PP54. The electroplated article according to any of embodiments PP1-PP53 wherein the electroplated metal layer has a thickness of greater than 3.0 μm.

PP55. The electroplated article according to any of embodiments PP1-PP53 wherein the electroplated metal layer has a thickness of greater than 6.0 μm.

PP56. The electroplated article according to any of embodiments PP1-PP53 wherein the electroplated metal layer has a thickness of greater than 8.0 μm.

PP57. The electroplated article according to any of embodiments PP1-PP56 wherein the polymeric substrate is a flexible polymer sheet.

PS1. An electroplating solution comprising:

i) x molar parts Cu(II) ions;

ii) y molar parts Sn (II) ions;

iii) z molar parts Zn(II) ions; and iv) m molar parts 1-methionine;

wherein x+y+z=100 and x is between 52 and 77, y is between 22 and 48, and z is between 1 and 9; and wherein m is between 1.6 and 6.0 times x.

PS2. The electroplating solution according to embodiment PS1 comprising no cyanide anion.

PS3. The electroplating solution according to any of embodiments PS1-PS2 wherein Cu(II) ions are provided as Cu(II) sulfate.

PS4. The electroplating solution according to any of embodiments PS1-PS3 wherein Sn(II) ions are provided as Sn (II) sulfate.

PS5. The electroplating solution according to any of embodiments PS1-PS4 wherein Zn(II) ions are provided Zn(II) sulfate.

PS6. The electroplating solution according to any of embodiments PS1-PS5 additionally comprising an antioxidant.

PS7. The electroplating solution according to embodiment PS6 wherein the antioxidant is ascorbic acid.

PS8. The electroplating solution according to embodiment PS6 wherein the antioxidant is d-sodium isoascorbate.

PS9. The electroplating solution according to any of embodiments PS1-PS8 wherein x is between 55 and 72, y is between 28 and 45.

PS10. The electroplating solution according to any of embodiments PS1-PS8 wherein x is between 60 and 70, y is between 30 and 40.

PS11. The electroplating solution according to any of embodiments PS1-PS10 wherein z is greater than 2.

PS12. The electroplating solution according to any of embodiments PS1-PS10 wherein z is greater than 3.

PS13. The electroplating solution according to any of embodiments PS1-PS12 wherein z is less than 7.

PS14. The electroplating solution according to any of embodiments PS1-PS13 wherein m is greater than 2.1 times x.

PS15. The electroplating solution according to any of embodiments PS1-PS13 wherein m is greater than 2.5 times x.

PS16. The electroplating solution according to any of embodiments PS1-PS15 wherein m is less than 4.0 times x.

M1. An electroplating method comprising the steps of:

a) immersing a polymeric substrate bearing a metallic tie/seed layer into an electroplating solution according to any of embodiments PS1-PS16; and b) passing an electrical current through the polymeric substrate so as to reduce anions in the electroplating solution.

M2. The electroplating method according to embodiment M1, additionally comprising the step of:

c) obtaining an electroplated article according to any of embodiments PP1-PP57.

M3. The electroplating method according any of embodiments M1-M2, wherein the electroplating solution is stirred, circulated or agitated during step b).

M4. The electroplating method according any of embodiments M1-M2, wherein the electroplating solution is allowed to remain still during step b).

M5. The electroplating method according embodiment M3, wherein the Cu/Sn ratio in the electroplated article is controlled by control of the rate of stirring of the electroplating solution during step b).

M6. The electroplating method according to any of embodiments M1-M5, wherein the electrical current is pulsed.

M7. The electroplating method according to any of embodiments M1-M6 wherein the tie/seed layer includes a layer of chromium in direct contact with the polymeric substrate.

M8. The electroplating method according to any of embodiments M1-M6 wherein the tie/seed layer includes a layer of chromium in direct contact with the polymeric substrate and a layer of copper in direct contact with the layer of chromium.

M9. The electroplating method according to any of embodiments M1-M6 wherein the tie/seed layer includes a layer of titanium in direct contact with the polymeric substrate.

M10. The electroplating method according to any of embodiments M1-M6 wherein the tie/seed layer includes a layer of titanium in direct contact with the polymeric substrate and a layer of copper in direct contact with the layer of titanium.

M11. The electroplating method according to any of embodiments M1-M6 wherein the tie/seed layer includes a layer of tin in direct contact with the polymeric substrate.

M12. The electroplating method according to any of embodiments M1-M6 wherein the tie/seed layer includes a layer of tin in direct contact with the polymeric substrate and a layer of copper in direct contact with the layer of tin.

M13. The electroplating method according to any of embodiments M1-M12 wherein the tie/seed layer has a thickness of less than 1.0 μm.

M14. The electroplating method according to any of embodiments M1-M12 wherein the tie/seed layer has a thickness of less than 0.3 μm.

M15. The electroplating method according to any of the embodiments M1-M14 wherein the polymeric substrate comprises a thermoplastic polymer.

M16. The electroplating method according to any of embodiments M1-M14 wherein the polymeric substrate comprises a thermoset polymer.

M17. The electroplating method according to any of embodiments M1-M14 wherein the polymeric substrate comprises a polyolefin polymer.

M18. The electroplating method according to any of embodiments M1-M14 wherein the polymeric substrate comprises a polypropylene polymer.

M19. The electroplating method according to any of embodiments M1-M14 wherein the polymeric substrate comprises a polyester polymer.

M20. The electroplating method according to any of embodiments M1-M14 wherein the polymeric substrate comprises a polyurethane polymer.

M21. The electroplating method according to any of embodiments M1-M14 wherein the polymeric substrate comprises a polymer derived from an epoxy resin.

M22. The electroplating method according to any of embodiments M1-M21 wherein the polymeric substrate has a thickness of less than 1400 μm.

M23. The electroplating method according to any of embodiments M1-M21 wherein the polymeric substrate has a thickness of less than 420 μm.

M24. The electroplating method according to any of embodiments M1-M21 wherein the polymeric substrate has a thickness of less than 280 μm.

M25. The electroplating method according to any of embodiments M1-M21 wherein the polymeric substrate has a thickness of less than 140 μm.

M26. The electroplating method according to any of embodiments M1-M21 wherein the polymeric substrate has a thickness of less than 70 μm.

M27. The electroplating method according to any of embodiments M1-M26 wherein the electroplated metal layer has a thickness of greater than 3 μm.

M28. The electroplating method according to any of embodiments M1-M26 wherein the electroplated metal layer has a thickness of greater than 682 m.

M29. The electroplating method according to any of embodiments M1-M26 wherein the electroplated metal layer has a thickness of greater than 8 μm.

Objects and advantages of this disclosure are further illustrated by the following examples, but the particular materials and amounts thereof recited in these examples, as well as other conditions and details, should not be construed to unduly limit this disclosure.

EXAMPLES

Unless otherwise noted, all reagents were obtained or are available from Sigma-Aldrich Company, St. Louis, Mo., or may be synthesized by known methods. Unless otherwise reported, all ratios are by weight percent.

The following abbreviations are used to describe the examples:

$A/dm^2$: Ampere per square decimeter
° C.: degrees Centigrade
cm: centimeter
ESCA: electron spectroscopy for chemical analysis
GPa: gigaPascals
ICP: inductively coupled plasma
mL: milliliter
mil: 1/1000 inch
μm: micrometer
msec: millisecond
rpm: revolutions per minute Abbreviations for the materials used in the examples are as follows:

$CuSO_4.5H_2O$: copper (II) sulfate pentahydrate
D-SIA: D-sodium isoascorbate
$H_2SO_4$: sulphuric acid
L-MTN: L-methothionine
NaCN: sodium cyanide
NaOH: sodium hydroxide
PST: potassium sodium tartrate (Rochelle Salt)
$SnSO_4$: in (II) sulfate
$Na_2SnO_3.3H_2O$: sodium tin oxide trihydrate
$ZnSO_4.7H_2O$: zinc sulfate heptahydrate,

Example 1A

A one liter aqueous plating solution was prepared by mixing 7 grams sodium hydroxide, 60 grams sodium cyanide, 30 grams copper (II) cyanide and 74.15 grams sodium tin oxide trihydrate in deionized water at 21° C. until completely dissolved. The plating solution was transferred to a plating bath and heated to 60° C. A 4 by 5 inch by 2 mil (10.16 by 12.7 cm by 50.8 μm) polypropylene sheet with electrically conductive tie/seed layer was used as a substrate. The tie/seed layer was applied by sputtering first chromium and then copper onto the polypropylene sheet to a total thickness of about 0.2 μm. The substrate was immersed in the plating solution. A pulse plating technique was used. A current density of 5 $A/dm^2$, at a pulse rate of 2.5 msec on/20 msec off, was applied for approximately 30 minutes, while stirring the plating solution at 200 rpm. The bronzed polypropylene sheet was removed from the plating solution, rinsed 3 times with deionized water and dried for 30 minutes at 21° C. ESCA and ICP analysis confirmed the sheet was uniformly coated with a 7 μm thick layer of homogeneous bronze alloy of 77 atomic percent copper and 23 atomic percent tin.

Example 1B

The procedure generally described for making the homogeneous bronze alloy plated polypropylene sheet in Example 1A was repeated, according to the plating solution and conditions listed in Table 1, at a current density of 3 $A/dm^2$ and a stir rate of 300 rpm. The resulting polypropylene sheet was determined to be uniformly coated with a 7 μm thick layer of homogeneous bronze alloy of 95 atomic percent copper and 5 atomic percent tin.

Example 2A

A one liter, cyanide-free, aqueous plating solution was prepared by mixing 32.5 grams copper (II) sulfate pentahydrate, 14.7 grams tin (II) sulfate, 53.3 mL sulfuric acid, 65 grams L-methionine and 10.0 grams Rochelle Salt in deionized water at 21° C. until completely dissolved. The plating solution was transferred to the plating bath and heated to 25° C. A 4 by 5 inch by 2 mil (10.16 by 12.7 cm by 50.8 μm) polypropylene sheet with electrically conductive tie/seed layer was used as a substrate. The tie/seed layer was applied by sputtering first chromium and then copper onto the polypropylene sheet to a total thickness of about 0.2 μm. The substrate was immersed in the plating solution. A pulse plating technique was used. A current density of 1.25 $A/dm^2$, at a pulse rate of 99.9 msec on/45 msec off, was applied for approximately 30 minutes, while stirring the plating solution at 200 rpm. The polypropylene sheet was removed from the plating solution, rinsed 3 times with deionized water and dried for 30 minutes at 21° C. The resulting polypropylene sheet was determined to be uniformly coated with a 7 μm thick layer of homogeneous bronze alloy of 95 atomic percent copper and 5 atomic percent tin.

Example 2B

The procedure generally described for making the homogeneous bronze alloy plated polypropylene sheet in Example 2A was repeated, wherein the stirring was turned off. The resulting polypropylene sheet was determined to be uniformly coated with a 7 μm thick layer of homogeneous bronze alloy of 70 atomic percent copper and 30 atomic percent tin.

With respect to Examples 2A and 2B, the plating solutions gradually oxidized, as exhibited by precipitation of tin dioxide sludge in the plating bath, after approximately 5 days.

Example 3A

The procedure generally described for making the homogeneous bronze alloy plated polypropylene sheet in Example 2A was repeated, wherein 1 gram of ascorbic acid was added to the plating solution. The resulting polypropylene sheet was determined to be uniformly coated with a 7 μm thick layer of homogeneous bronze alloy of 95 atomic percent copper and 5 atomic percent tin.

Example 3B

The procedure generally described for making the homogeneous bronze alloy plated polypropylene sheet in Example 3A was repeated, wherein the ascorbic acid was substituted with 1.2 grams D-sodium isoascorbate. Again, resulting polypropylene sheet was determined to be uniformly coated with a 7 μm thick layer of homogeneous bronze alloy of 95 atomic percent copper and 5 atomic percent tin.

Example 3C

The procedure generally described for making the homogeneous bronze alloy plated polypropylene sheet in Example 3A was repeated, wherein the stirring was turned off. The resulting polypropylene sheet was determined to be uniformly coated with a 7 μm thick layer of homogeneous bronze alloy of 70 atomic percent copper and 30 atomic percent tin.

Example 3D

The procedure generally described for making the homogeneous bronze alloy plated polypropylene sheet in Example 3B was repeated, wherein the stirring was turned off. The resulting polypropylene sheet was determined to be uniformly coated with a 7 μm thick layer of homogeneous bronze alloy of 70 atomic percent copper and 30 atomic percent tin.

Plating solutions 3A-3D did not exhibit tin oxide precipitation even after 45 days. A small amount of carbon residue was visible in solutions 3A and 3B, which included ascorbic acid (AA) antioxidant. Such carbon residue may be removed by charcoal filtration. However reduced carbon residue was visible in solutions 3C and 3D, which included d-sodium isoascorbate (D-SIA) antioxidant.

Examples 4A-4D

The procedures generally described for making the homogeneous bronze alloy plated polypropylene sheet Examples 3A-3D were repeated, under the conditions reported in Table I, however 3 grams zinc sulfate heptahydrate was added to each of the plating solutions. The resulting polypropylene sheets were determined to be uniformly coated with a 7 μm thick layer of homogeneous bronze alloy of 95 atomic percent copper and 5 atomic percent tin for Examples 4A and 4C, and 70 atomic percent copper and 30 atomic percent tin for Example 4B and 4D.

Example 4E

The procedure generally described for making the homogeneous bronze alloy plated polypropylene sheet in Example 4C was repeated, wherein the plating time was increased to approximately 40 minutes. The resulting polypropylene sheet was determined to be uniformly coated with a 10 μm thick layer of homogeneous bronze alloy of 95 atomic percent copper and 5 atomic percent tin.

Example 4F

The procedure generally described for making the homogeneous bronze alloy plated polypropylene sheet in Example 4D was repeated, wherein the plating time was increased to approximately 40 minutes. The resulting polypropylene sheet was determined to be uniformly coated with a 10 μm thick layer of homogeneous bronze alloy of 70 atomic percent copper and 30 atomic percent tin.

Examples 3A (without zinc) and 4A (with zinc) were evaluated for microhardness according to ASTM B578, from which Young's Modulus were calculated to be 16.1 GPa for Example 3A and 9.7 GPa for Example 4A. Furthermore, Example 4A was able to withstand a bend in the bronze alloy coated polypropylene sheet of 90 degrees without cracking. The sheet was bent in the direction away from the electroplated side, so as to put the electroplated bronze layer under tensile stress. Example 3A failed this bending test, as the electroplated bronze layer cracked

TABLE 1

| | Example: | | | | | | | | | | | | | |
|---|---|---|---|---|---|---|---|---|---|---|---|---|---|---|
| | 1A | 1B | 2A | 2B | 3A | 3B | 3C | 3D | 4A | 4B | 4C | 4D | 4E | 4F |
| | Plating Solution Components (g/liter) | | | | | | | | | | | | | |
| NaOH | 7 | 7 | 0 | 0 | 0 | 0 | 0 | 0 | 0 | 0 | 0 | 0 | 0 | 0 |
| NaCN | 60 | 40 | 0 | 0 | 0 | 0 | 0 | 0 | 0 | 0 | 0 | 0 | 0 | 0 |
| CuCN | 30 | 40 | 0 | 0 | 0 | 0 | 0 | 0 | 0 | 0 | 0 | 0 | 0 | 0 |
| $Na_2SnO_3 \cdot 3H_2O$ | 74.15 | 30 | 0 | 0 | 0 | 0 | 0 | 0 | 0 | 0 | 0 | 0 | 0 | 0 |
| $CuSO_4 \cdot 5H_2O$ | 0 | 0 | 32.5 | 32.5 | 32.5 | 32.5 | 32.5 | 32.5 | 32.5 | 32.5 | 32.5 | 32.5 | 32.5 | 32.5 |
| $SnSO_4$ | 0 | 0 | 14.7 | 14.7 | 14.7 | 14.7 | 14.7 | 14.7 | 14.7 | 14.7 | 14.7 | 14.7 | 14.7 | 14.7 |
| $H_2SO_4$ (ml/liter) | 0 | 0 | 53.3 | 53.3 | 53.3 | 53.3 | 53.3 | 53.3 | 53.3 | 53.3 | 53.3 | 53.3 | 53.3 | 53.3 |
| L-MTN | 0 | 0 | 65 | 65 | 65 | 65 | 65 | 65 | 65 | 65 | 65 | 65 | 65 | 65 |
| PST | 0 | 0 | 10 | 10 | 10 | 10 | 10 | 10 | 10 | 10 | 10 | 10 | 10 | 10 |
| AA | 0 | 0 | 0 | 0 | 1 | 0 | 1 | 0 | 1 | 1 | 0 | 0 | 0 | 0 |
| D-SIA | 0 | 0 | 0 | 0 | 0 | 1.2 | 0 | 1.2 | 0 | 0 | 1.2 | 1.2 | 1.2 | 1.2 |

TABLE 1-continued

| | Example: | | | | | | | | | | | | | |
|---|---|---|---|---|---|---|---|---|---|---|---|---|---|---|
| | 1A | 1B | 2A | 2B | 3A | 3B | 3C | 3D | 4A | 4B | 4C | 4D | 4E | 4F |
| $ZnSO_4 \cdot 7H_2O$ | 0 | 0 | 0 | 0 | 0 | 0 | 0 | 0 | 3 | 3 | 3 | 3 | 3 | 3 |
| Cu/Sn atomic ratio | 0.71 | 2.48 | 1.9 | 1.9 | 1.9 | 1.9 | 1.9 | 1.9 | 1.9 | 1.9 | 1.9 | 1.9 | 1.9 | 1.9 |
| Cu/Sn/Zn atomic ratio | | | | | | | | | 62/33/5 | 62/33/5 | 62/33/5 | 62/33/5 | 62/33/5 | 62/33/5 |
| Plating Conditions | | | | | | | | | | | | | | |
| Current Density ($A/dm^2$) | 5 | 3 | 1.25 | 1.25 | 1.25 | 1.25 | 1.25 | 1.25 | 1.25 | 1.25 | 1.25 | 1.25 | 1.25 | 1.25 |
| Stir rate (rpm) | 200 | 300 | 200 | 0 | 200 | 200 | 0 | 0 | 200 | 0 | 200 | 0 | 200 | 0 |
| Duration (min) | 30 | 30 | 30 | 30 | 30 | 30 | 30 | 30 | 30 | 30 | 30 | 30 | 40 | 40 |
| Characteristics of Plated Layer | | | | | | | | | | | | | | |
| Cu/Sn atomic ratio | 77/23 | 95/5 | 95/5 | 70/30 | 95/5 | 95/5 | 70/30 | 70/30 | 95/5 | 70/30 | 95/5 | 70/30 | 95/5 | 70/30 |
| Layer thickness (μm) | 7 | 7 | 7 | 7 | 7 | 7 | 7 | 7 | 7 | 7 | 7 | 7 | 10 | 10 |

Various modifications and alterations of this disclosure will become apparent to those skilled in the art without departing from the scope and principles of this disclosure, and it should be understood that this disclosure is not to be unduly limited to the illustrative embodiments set forth hereinabove.

We claim:

1. An electroplating solution comprising:

i) x molar parts Cu(II) ions;

ii) y molar parts Sn (II) ions;

iii) z molar parts Zn(II) ions; and iv) m molar parts 1-methionine;

wherein x+y+z=100 and x is between 52 and 77, y is between 22 and 48, and z is between 1 and 9; and wherein m is between 1.6 and 6.0 times x.

2. An electroplating method comprising the steps of:

a) immersing a polymeric substrate bearing a metallic tie/seed layer into an electroplating solution, wherein the polymeric substrate bears an electroplated metal layer comprising copper and tin in an atomic ratio of less than 96:4 and greater than 55:45, wherein the electroplated metal layer comprises at least 3.5 weight % tin; and wherein the electroplating solution comprises:

i) x molar parts Cu(II) ions;

ii) y molar parts Sn (II) ions;

iii) z molar parts Zn(II) ions;

iv) m molar parts 1-methionine, and v) an antioxidant selected from the group consisting of ascorbic acid and d-sodium isoascorbate, wherein x+y+z=100 and x is between 52 and 77, y is between 22 and 48, and z is between 1 and 9; and wherein m is between 1.6 and 6.0 times x; and b) passing an electrical current through the polymeric substrate so as to reduce anions in the electroplating solution.

3. The electroplating method according to claim 2, wherein the electroplating solution is stirred, circulated or agitated during step b) and wherein the Cu/Sn ratio in the electroplated article is controlled by control of the rate of stirring of the electroplating solution during step b).

4. The electroplating method according to claim 2, wherein the electrical current is pulsed.

5. The electroplating method according to claim 2, wherein the electroplated metal layer comprises copper and tin in an atomic ratio of greater than 55:45 and less than 87:13.

6. The electroplating method according to claim 2, wherein the electroplated metal layer comprises copper and tin in an atomic ratio of greater than 55:45 and less than 82:18.

7. The electroplating method according to claim 2, wherein the electroplated metal layer comprises an alloy having a melting point of less than 800° C.

8. The electroplating method according to claim 2, wherein the electroplated metal layer additionally comprises greater than 0.001 weight % zinc.

9. The electroplating method according to claim 2, wherein the electroplated metal layer additionally comprises greater than 0.01 weight % sulfur.

10. The electroplating method according to claim 2, wherein the electroplated metal layer has a Young's Modulus of less than 15.0 GPa.

11. The electroplating method according to claim 10, wherein the electroplated metal layer has a Young's Modulus of less than 10.0 GPa.

12. The electroplating method according to claim 2, wherein the tie/seed layer is in direct contact with the polymeric substrate.

13. The electroplating method according to claim 2, wherein the polymeric substrate comprises a thermoplastic polymer.

14. The electroplating method according to claim 2, wherein the polymeric substrate comprises a polymer derived from an epoxy resin.

15. The electroplating method according to claim 2, wherein the electroplating solution comprises no cyanide anion.

16. The electroplating method according to claim 2, wherein Cu(II) ions are provided as Cu(II) sulfate, Sn(II) ions are provided as Sn (II) sulfate, and Zn(II) ions are provided Zn(II) sulfate.

17. The electroplating method according to claim 2, wherein x is between 60 and 70, y is between 30 and 40, z is between 3 and 9, and m is between 2.5 and 6.0 times x.

* * * * *